US010545006B1

(12) United States Patent
Zhang

(10) Patent No.: US 10,545,006 B1
(45) Date of Patent: Jan. 28, 2020

(54) UNIVERSAL MOUNTING DEVICE FOR PISTOL ARMREST

(71) Applicant: Hong Jun Zhang, City of Industry, CA (US)

(72) Inventor: Hong Jun Zhang, City of Industry, CA (US)

(73) Assignee: Trinity Force Corporation (USA), City of Industry, CA (US)

( * ) Notice: Subject to any disclaimer, the term of this patent is extended or adjusted under 35 U.S.C. 154(b) by 0 days.

(21) Appl. No.: 16/252,498

(22) Filed: Jan. 18, 2019

(51) Int. Cl.
*F41C 23/00* (2006.01)
*F41C 23/12* (2006.01)

(52) U.S. Cl.
CPC ..... *F41C 23/12* (2013.01)

(58) Field of Classification Search
CPC ..... F41C 23/00; F41C 23/04; F41C 23/06; F41C 23/12; F41C 23/14; F41C 23/20; F41C 23/22
See application file for complete search history.

(56) References Cited

U.S. PATENT DOCUMENTS 1,357,232 A * 11/1920 Green ..... F41C 23/12 42/73
1,384,386 A * 7/1921 Green ..... F41C 23/00 42/72
9,354,021 B2 * 5/2016 Bosco ..... F41C 33/001
9,664,477 B1 * 5/2017 Reavis ..... F41C 27/22
9,696,110 B2 * 7/2017 Hollis ..... F41C 33/001
9,746,282 B1 * 8/2017 Huang ..... F41C 23/20

* cited by examiner

*Primary Examiner* — Gabriel J. Klein
(74) *Attorney, Agent, or Firm* — Raymond Y. Chan; David and Raymond Patent Firm

(57) ABSTRACT

A universal mounting device for a pistol having a rear extended connecting extension, wherein the universal mounting device includes a buttstock body having an elongated holding channel for slidably receiving the connecting extension therealong, and a locking mechanism provided at the buttstock body to selectively adjust a diameter size of the holding channel. The locking mechanism is actuated to reduce the diameter size of the holding channel for tightly pressing an inner wall of the holding channel at an outer wall of the connecting extension so as to lock up the connecting extension at the holding channel.

8 Claims, 6 Drawing Sheets

UNIVERSAL MOUNTING DEVICE FOR PISTOL ARMREST

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to pistol accessories, and more particularly to a universal mounting device for a pistol armrest, which forms a universal pistol brace that can rapidly attach to or detach from the pistol armrest.

Description of Related Arts

Generally speaking, how to hold a pistol has a huge effect on the shooting accuracy. There are many existing tips or techniques to improve the shooting accuracy, such as shooting stance and pistol gripping method. However, it is always a challenge for a person to hold the pistol by hands steady for a period of time and to fire the pistol accurately.

A buttstock, which is also known as a shoulder stock, a stock or a butt, is a rear part of a rifle. Accordingly, the buttstock is biased against a user's shoulder during a shooting operation of the rifle in order to let the user to hold the rifle stably, so that the backlash vibration generated in the shooting operation can be evenly transmitted to the user's body. Thus, by holding the buttstock at the user's shoulder, the user's body will not be easy to get hurt in the backlash movement of the rifle. In addition, since the buttstock provides a support to the rifle, it also enhances the stability when aiming and shooting, so as to increase the shooting accuracy.

The buttstock can be a fixed and irremovable part of the rifle. On the other hand, the user prefers to use a collapsible buttstock as it is comfortable to use. It has the ability to be used as a long, fixed stock for controlled, accurate firing. It also can be adjusted to fit the individual shooters, thus making the shooter as comfortable as possible when shooting. When in not use, the collapsible buttstock can be disassembled from the rifle, so that the total length of the firearm is reduced, and the rifle can be easily stored for carrying and travelling. Furthermore, the collapsible buttstock can be assembled with another rifle, helping the user to save costs. In other words, one collapsible buttstock can fit different rifles via different adapters.

However, the conventional collapsible buttstock is not convenient to assemble or disassemble, it is time and effort consuming before the shooter is ready for shooting. Accordingly, the conventional collapsible buttstock which includes a butt body and a locking lever arrangement for connecting to a connecting barrel of the rifle. For detaching the collapsible buttstock from the rifle the user has to use one hand to hold firmly at an upper portion of the rifle, and to use another hand to grasp the entire locking lever arrangement. Therefore, the locking lever arrangement can be pivotally pulled away from the butt body fully retract a lever lock pin of the locking lever arrangement from a chamber of the butt body for unlocking the connecting barrel. Then, the buttstock can be slid backward to disengage from the barrel of the rifle.

For installing the collapsible buttstock, similarly, the user has to use one hand to hold firmly at the upper portion of the rifle, and to use another hand to pull the locking lever arrangement away from the butt body for enabling the connecting barrel to slide into the chamber of the butt body. Actually, the removal or installation of the collapsible buttstock requires a great effort in the pulling and pressing process, so that it is often accomplished by fixing the rifle in a gunsmith's rifle vice or fixture. In another case, the user may have to user both hands to operate on the lock lever arrangement. For example, the user has to use fingers of two hands to press an end of the lock lever arrangement to an utmost position for displacing the lock lever pin. It is thus can be seen that the conventional collapsible buttstock has a disadvantage that the user cannot quickly the detach or install the conventional collapsible buttstock for usage.

SUMMARY OF THE PRESENT INVENTION

The invention is advantageous in that it provides a universal mounting device, which forms a universal pistol brace that can rapidly attach to or detach from the pistol armrest.

Another advantage of the invention is to a universal mounting device, which can quickly lock up a connecting extension before or after the connecting extension is couple with the pistol.

Another advantage of the invention is to a universal mounting device, wherein the connecting extension is locked up along the holding channel by reducing a diameter size of the holding channel to tightly press an inner wall of the holding channel at an outer wall of the connecting extension, so as to prevent any damage of the connecting extension.

Another advantage of the invention is to a universal mounting device, wherein the diameter size of the holding channel can be selectively adjusted to fit different sizes of the connecting extension, such that no adapter is required for connecting the pistol with the universal mounting device.

Another advantage of the invention is to a universal mounting device, wherein a protrusion portion of the connecting extension can be selectively adjusted to control a distance between the universal mounting device and the pistol.

Another advantage of the invention is to provide a universal mounting device, which can be incorporated with different existing pistols each having the connecting extension.

Another advantage of the invention is to a universal mounting device, which does not require to alter the original structural design of the pistol and the connecting extension, so as to minimize the cost of the universal mounting device incorporating with the pistol having the connecting extension.

Another advantage of the invention is to a universal mounting device, wherein no expensive or complicated structure is required to employ in the present invention in order to achieve the above mentioned objects. Therefore, the present invention successfully provides an economic and efficient solution for providing a simple and secure configuration for connecting the universal mounting device to the pistol via the connecting extension.

Additional advantages and features of the invention will become apparent from the description which follows, and may be realized by means of the instrumentalities and combinations particular point out in the appended claims.

According to the present invention, the foregoing and other objects and advantages are attained by a universal mounting assembly for a pistol armrest, comprising a connecting extension and a universal mounting device.

The connecting extension, which has an elongated structure, has a front end adapted for detachably coupling to the pistol armrest.

The universal mounting device comprises a buttstock body and a locking mechanism. The buttstock body has an elongated holding channel, wherein the connecting extension is slidably coupled at the holding channel of the buttstock body at a position that the front end of the connecting extension is frontwardly extended from the buttstock body. The locking mechanism is provided at the buttstock body to selectively adjust a diameter size of the holding channel, wherein when the connecting extension is slid along the holding channel, the locking mechanism is actuated to reduce the diameter size of the holding channel to lock up at least a portion of the connecting extension at the holding channel.

In accordance with another aspect of the invention, the present invention comprises a method of mounting a universal mounting device to a pistol, comprising the following steps.

(A) Couple a front end of an elongated connecting extension to a rear end of the pistol.

(B) Slide the connecting extension along an elongated holding channel of a buttstock body.

(C) Lock up at least a portion of the connecting extension at the holding channel via a locking mechanism by reducing a diameter size of the holding channel in order to tightly press an inner wall of the holding channel at an outer wall of the connecting extension.

In accordance with another aspect of the invention, the present invention comprises a universal mounting device for a pistol which comprises a rear extended connecting extension, comprising:

a buttstock body having an elongated holding channel for slidably receiving the connecting extension therealong; and a locking mechanism provided at the buttstock body to selectively adjust a diameter size of the holding channel, wherein the locking mechanism is actuated to reduce the diameter size of the holding channel for tightly pressing an inner wall of the holding channel at an outer wall of the connecting extension so as to lock up at least a portion of the connecting extension at the holding channel.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
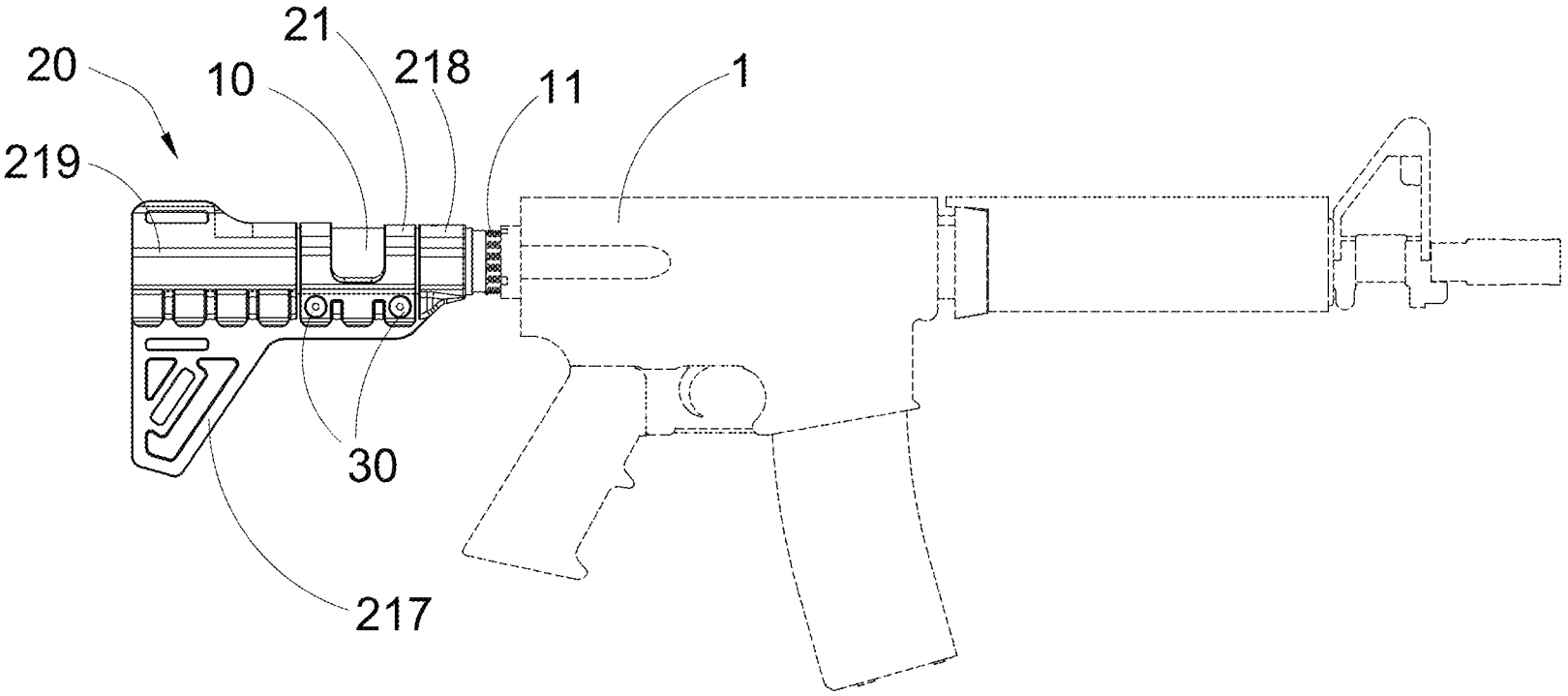
FIG. 1 is a perspective view of a universal mounting assembly for a pistol according to a preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIGS. 1 to 4 of the drawings, a universal mounting assembly for a pistol is illustrated, wherein the pistol, which comprises a pistol armrest 1, can be embodied as a hand gun such as, "Glock", or a rifle such as "CZ Scorpion Evo 3". The universal mounting assembly comprises a connecting extension 10 and a universal mounting device.

The connecting extension 10, which has an elongated structure, has a front end 11 adapted for detachably coupling to the pistol armrest 1 of the pistol. Accordingly, the front end 11 of the connecting extension 10 has a threaded structure rotatably coupled to the pistol armrest 1, such that the connecting extension 10 is rearwardly extended from the pistol. Preferably, the connecting extension 10 has a circular cross section to have a uniform outer diameter size. It is worth mentioning that the connecting extension 10 can be a part of the pistol, wherein the front end 11 of the connecting extension 10 is designed to have a particular size in order to couple the connecting extension 10 to the pistol armrest 1 of the pistol.

As shown in FIGS. 1 to 4, the universal mounting device comprises a buttstock body 20 and a locking mechanism 30. The universal mounting device is embodied as a universal pistol brace or a universal pistol stabilizer so as to allow the user to hold the pistol stably.

The buttstock body 20 has an elongated holding channel 201, wherein the connecting extension 10 is slidably coupled at the holding channel 201 of the buttstock body 20 at a position that the front end 11 of the connecting extension 10 is frontwardly extended from the buttstock body 20. Accordingly, a diameter size of the holding channel 201 is slightly larger than the diameter size of the connecting extension 10, such that the connecting extension 10 can be freely slid along the holding channel 201. Preferably, a distance of the holding channel 201 is shorter than a length of the connecting extension 10. It is worth mentioning that the diameter size of the holding channel 201 is adjustable.

The locking mechanism 30 is provided at the buttstock body 20 to selectively adjust the diameter size of the holding channel 201 thereof, wherein when the connecting extension 10 is slid along the holding channel 201, the locking mechanism 30 is actuated to reduce the diameter size of the holding channel 201 to lock up at least a portion of the connecting extension 10 at the holding channel 201. In other words, the buttstock body 20 is moved between an unlocked position and a locked position. At the unlocked position, the connecting extension 10 is able to freely slide along the holding channel 201 to selectively adjust a protruding length of the front end 11 of the connecting extension 10 being frontwardly extended out of the buttstock body 20. At the locked position, the diameter size of the holding channel 201 is reduced to lock up the connecting extension 10 at the holding channel 201.

According to the preferred embodiment, the buttstock body 20 comprises a tubular holding member 21 defining the holding channel 201 therealong. The holding member 21 comprises a stationary edge 211 integrally extended from the buttstock body 20 and a free edge 212 spacedly extended along the stationary edge 211 side-by-side to define an adjustment clearance 213 therebetween. The holding member 21 generally has a C-shaped cross section, wherein the holding member 21 further comprises a circular shaped channel member 214 that the stationary edge 211 and the free edge 212 are extended along two opening edges of the channel member 214 of the holding member 21. Preferably, a thickness of the stationary edge 211 is different from a thickness of the free edge 212. In particularly, the stationary edge 211 is thicker than the free edge 212. Accordingly, at the unlocked position, the adjustment clearance 213 should be wide enough for configure the diameter size of the holding channel 201 for allowing the connecting extension 10 being freely slid along the holding channel 201. At the locked position, the free end 212 of the holding member 21 toward the stationary edge 211 thereof that the adjustment clearance 213 should be narrow enough for reducing the diameter size of the holding channel 201 to tightly press an inner wall of the holding channel 201 at an outer wall of the connecting extension 10.

Figure 5:
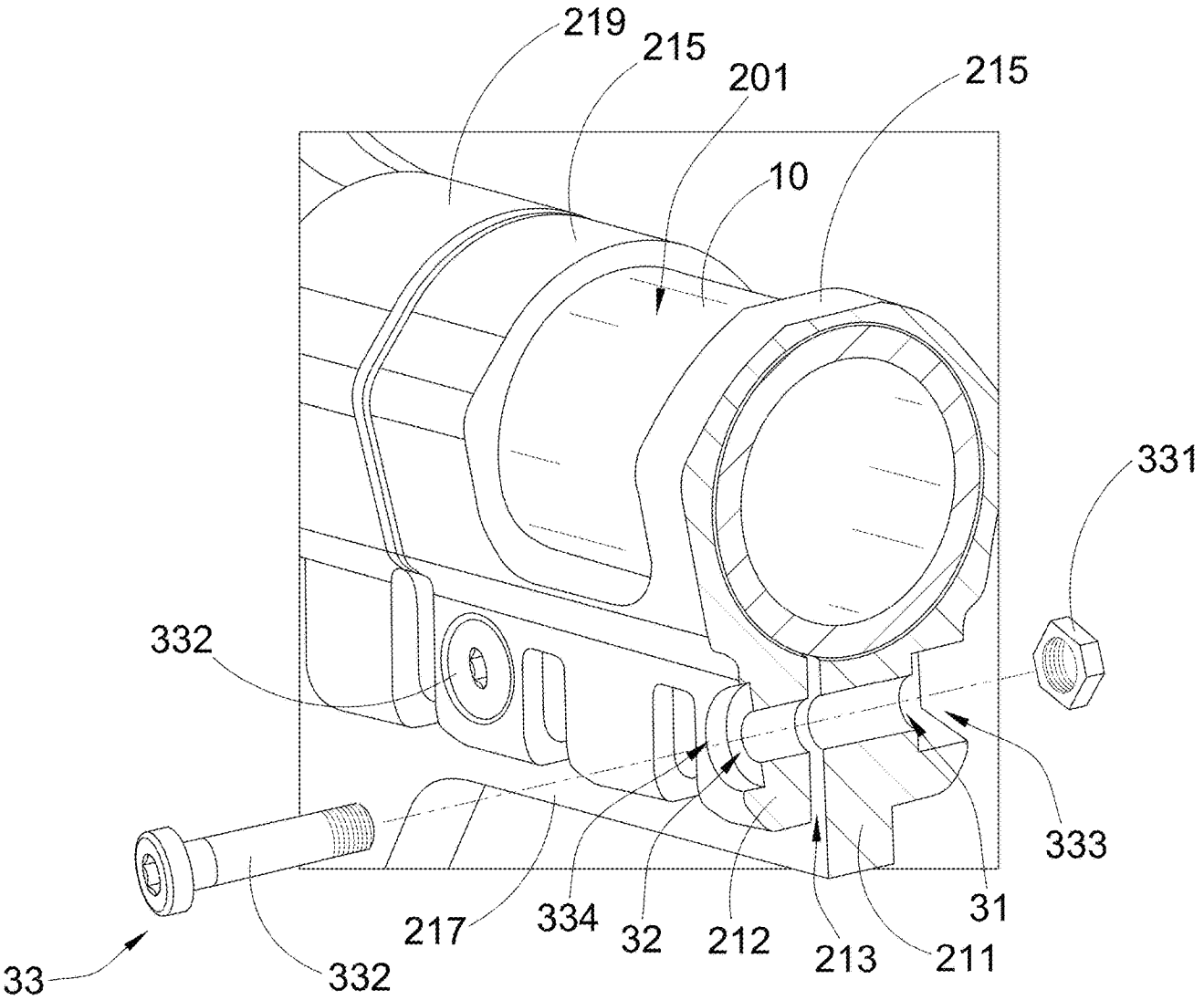
FIG. 5 is a sectional view of the universal mounting device according to the above preferred embodiment of the present invention, illustrating the locking mechanism.

As shown in FIG. 5, each of the stationary edge 211 and the free edge 212 are formed as two elongated edge members spacedly extended side-by-side to define the adjustment clearance 213 therebetween, wherein the adjustment clearance 213 is embodied as an elongated gap between the stationary edge 211 and the free edge 212.

According to the preferred embodiment, the locking mechanism 30 is actuated to press the free end 212 of the holding member 21 toward the stationary edge 211 thereof to reduce the diameter size of the holding channel 201 so as to lock up at least a portion of the connecting extension 10 at the holding channel 201. It is worth mentioning that when the free end 212 of the holding member 21 is pressed toward the stationary edge 211 thereof, a width of the adjustment clearance 213 is reduced, such that the diameter size of the holding channel 201 will be substantially reduced. Therefore, the inner wall of the holding channel 201 is tightly pressed at the outer wall of the connecting extension 10, i.e. an outer circumferential wall thereof, so as to lock up the connecting extension 10 at the holding channel 201.

Figure 2:
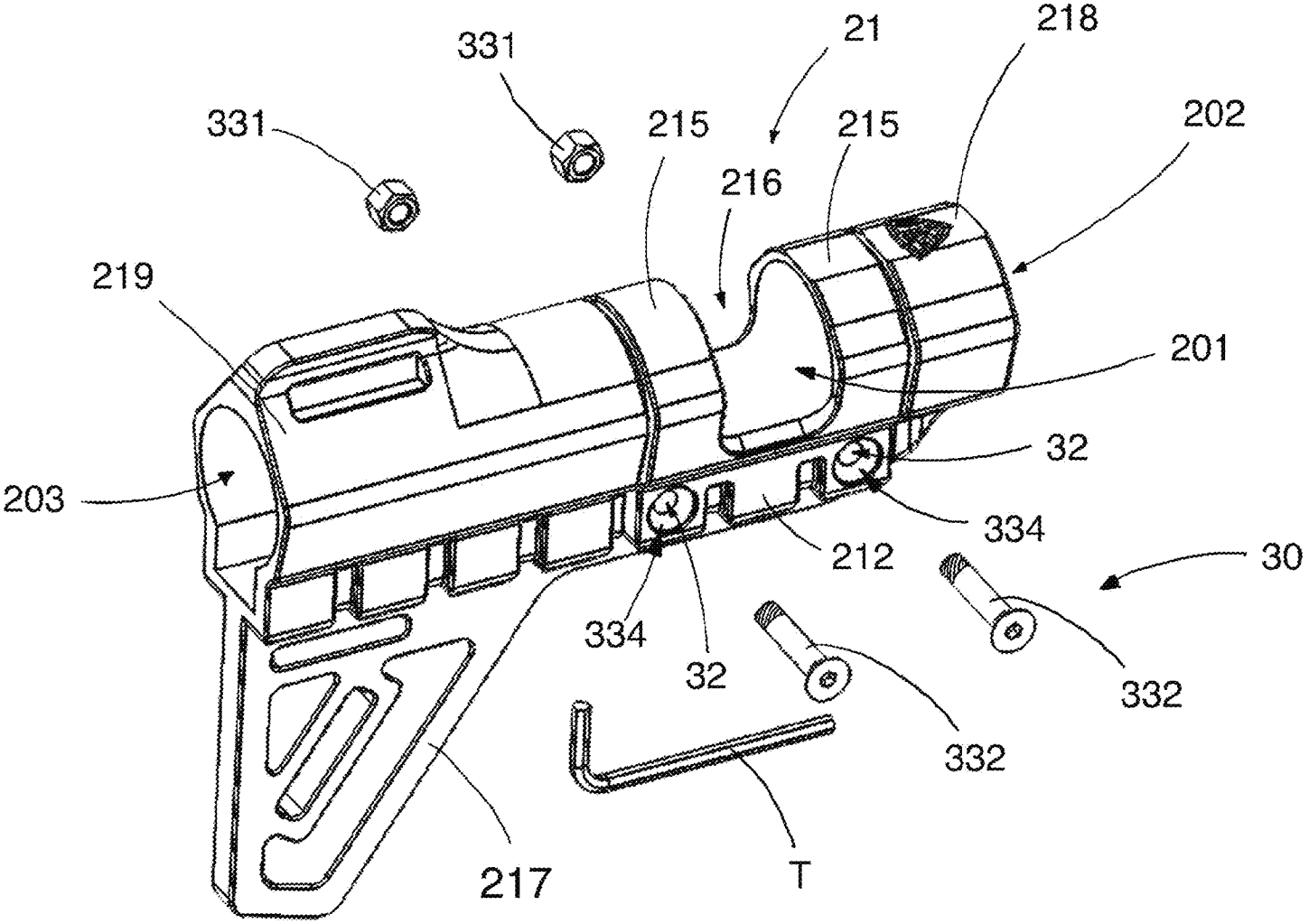
FIG. 2 is an exploded perspective view of the universal mounting device according to the above preferred embodiment of the present invention.
Figure 3:
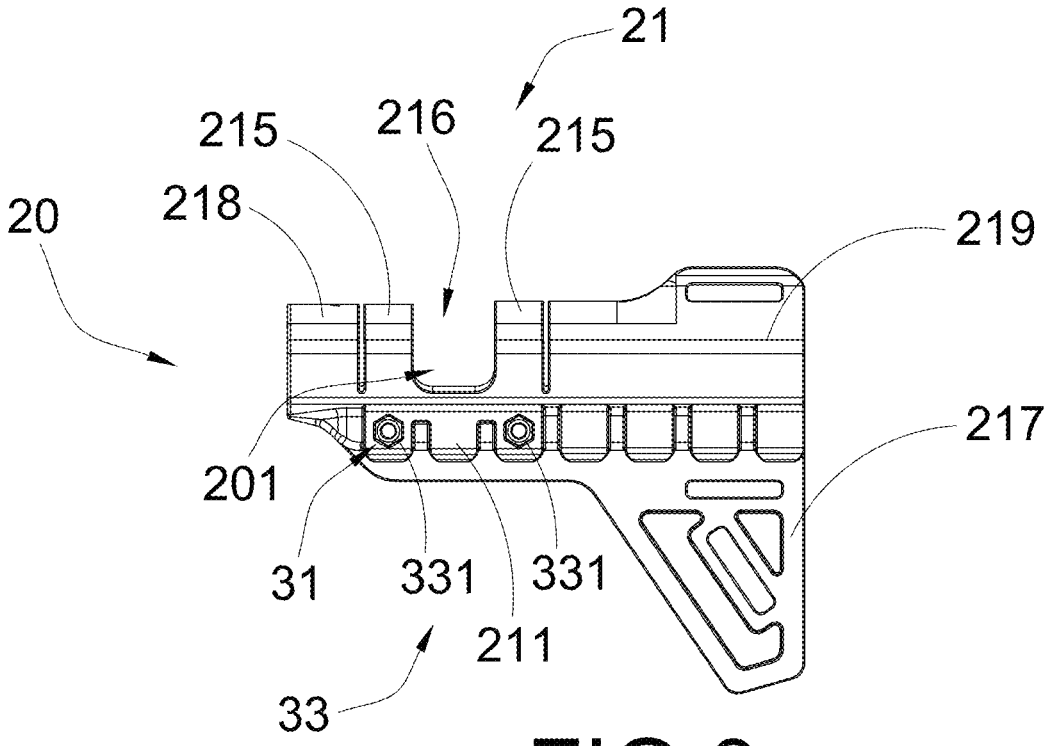
FIG. 3 is a right side view of the universal mounting assembly according to the above preferred embodiment of the present invention.
Figure 4:
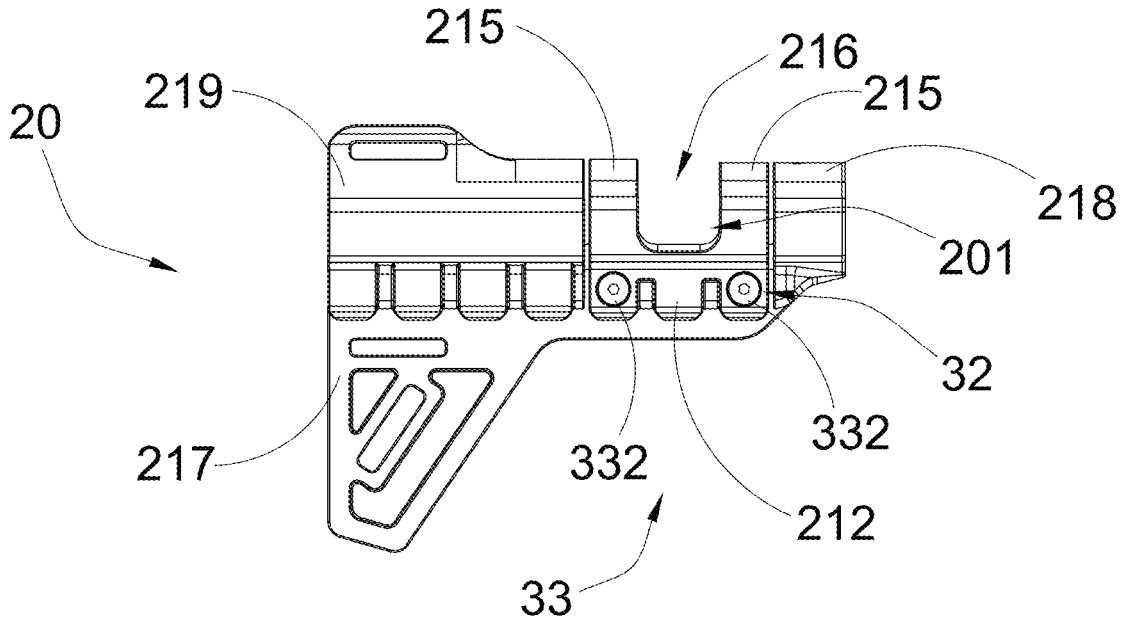
FIG. 4 is a left side view of the universal mounting assembly according to the above preferred embodiment of the present invention

As shown in FIGS. 2 to 4, the holding member 21 comprises two spaced apart holding rings 215 to define a holding window 216 therebetween. Particularly, the holding rings 215 are constructed to form the channel member 214. The stationary edge 211 is integrally extended from two corresponding ends of the holding rings 215 while the free edge 212 is integrally extended from another two corresponding ends of the holding rings 215. It is worth mentioning that when the free end 212 of the holding member 21 is pressed toward the stationary edge 211 thereof to reduce the diameter size of the holding channel 201, the inner wall of the holding channel 201 is tightly pressed at the outer wall of the connecting extension 10. Therefore, by configuring two spaced apart holding rings 215, a contact area between the inner wall of the holding channel 201 and the outer wall of the connecting extension 10 will be reduced to reduce the pressing pressure against the connecting extension 10 so as to prevent any damage of the connecting extension 10 and/or the holding member 21. It is worth mentioning that the connecting extension 10 can still be tightly locked at the holding channel 201 via the holding rings 215. It is worth mentioning that the buttstock body 20 is able to fit different diameter sizes of the connecting extensions 10 for different pistols by selectively adjusting the diameter size of the holding channel 201 to fit the diameter size of the connecting extension 10.

According to the preferred embodiment, the buttstock body 21 comprises a stock base 217, a front retention member 218 having a front channel 202 and a rear retention member 219 having a rear channel 203.

The stock base 217 has a triangular shape and is arranged for biasing against a user's shoulder during a shooting operation of the pistol. The holding member 21 is upwardly extended from the stock base 217 at a position that the stationary edge 211 of the holding member 21 is integrally and upwardly extended from the stock base 217.

Accordingly, the front and rear retention members 218, 219 are two tubular members to define the front and rear channels 202, 203 therewithin respectively. Preferably, a diameter size of each of the front and rear channels 202, 203 are slightly larger than the diameter size of the connecting extension 10, such that the connecting extension 10 can be freely slid along the front and rear channels 202, 203.

The front and rear retention members 218, 219 are integrally and upwardly extended from the stock base 217, wherein the front and rear channels 202, 203 are coaxially aligned with each other. Particularly, the front and rear retention members 218, 219 are integrally and upwardly extended from front and rear portions of the stock base 217 respectively, wherein the holding member 21 is supported between the front and rear retention members 218, 219. Accordingly, the stationary edge 211 of the holding member 21 is integrally and upwardly extended from the stock base 217 between the front and rear retention members 218, 219 at a position that the holding channel 201 is aligned between the front and rear channels 202, 203, such that the connecting extension 10 is slid along the front and rear channels 202, 203 and is tightly locked at the holding channel 201. In other words, when the connecting extension 10 is slid along the front channel 202, the holding channel 201, and the rear channel 203, front and rear portions of the connecting extension 10 are received within the front and rear channels 202, 203 while a mid-portion of the connecting extension 10 is locked within the holding channel 201. Therefore, the connecting extension 10 can be securely and stably coupled at the buttstock body 20.

According to the preferred embodiment, the locking mechanism 30 comprises at least a first locking slot 31 formed at the stationary edge 211 of the holding member 21, at least a second locking slot 32 formed at the free edge 212 of the holding member 21 to coaxially align with the first locking slot 31, and an actuation locker 33 extended to the first locking slot 31 through the second locking slot 32 to move the free end 212 of the holding member 21 toward the stationary edge 211 thereof.

As shown in FIGS. 2 to 4, two first locking slots 31 are spacedly formed at the stationary edge 211 of the holding member 21 and are positioned below two corresponding ends of the holding rings 215. Correspondingly, two second locking slots 32 are spacedly formed at the free edge 212 of the holding member 21 and are positioned below another two corresponding ends of the holding rings 215. Two actuation lockers 33 are extended through the second locking slots 32 to the first locking slots 31 respectively in order to adjust the diameter size of the holding channel 201 via the adjustment clearance 213.

As shown in FIG. 5, the actuation locker 33 comprises a locking nut 331 positioned at the stationary edge 211 of the holding member 21 and a locking bolt 332 extended from the second locking slot 32 through the first locking slot 31 to rotatably engage with the locking nut 331 so as to press the free edge 212 of the holding member 21 to the stationary edge 211 thereof. In other words, an outer threaded portion of the locking bolt 332 is rotatably engaged with an inner threaded portion of the locking unit 331 to selectively control the width of the adjustment clearance 213 so as to selectively adjust the diameter size of the holding channel 201. The locking bolt 332 has an elongated bolt body and an enlarged pressing head, wherein the bolt body of the locking 332 is extended through the first and second locking slots 31, 32 to engage with the locking nut 331 until the pressing head of the locking bolt 332 is pressed against the free edge 212 of the holding member 21. It is worth mentioning that the locking bolt 332 has a non-circular tool slot formed at the pressing head, wherein a tool T is used for engaging with the tool slot in order to drive the locking bolt 332 to rotate.

Accordingly, the actuation locker 33 further has a nut cavity 333 indently formed at the stationary edge 211 of the holding member 21 to coaxially align with the first locking slot 31, wherein the locking nut 331 is received in the nut cavity 333 to engage with the locking bolt 332. In one embodiment, two nut cavities 333 are formed at the stationary edge 211 of the holding member 21 below two ends of the holding rings 215, wherein two locking nuts 331 are received in the nut cavities 333 to engage with the locking bolts 332 respectively. It is worth mentioning that the nut cavity 333 has a non-circular shape corresponding to the shape of the locking nut 331, such that when the locking unit 331 is disposed in the nut cavity 333, the locking unit 331 cannot be rotated within the nut cavity 333.

Correspondingly, the actuation locker 33 further has a bolt cavity 334 indently formed at the free edge 212 of the holding member 21 to coaxially align with the second locking slot 32, wherein the pressing head of the locking bolt 332 is received in the bolt cavity 334 when the locking bolt 332 is engaged with the locking bolt 332. In one embodiment, two bolt cavities 334 are formed at the free edge 212 of the holding member 22 below two ends of the holding rings 215, wherein two pressing heads of the locking bolts 332 are received in the bolt cavities 334 respectively. It is worth mentioning that the bolt cavity 334 has a circular shape corresponding to the shape of the pressing head of the locking bolt 332.

Figure 6:
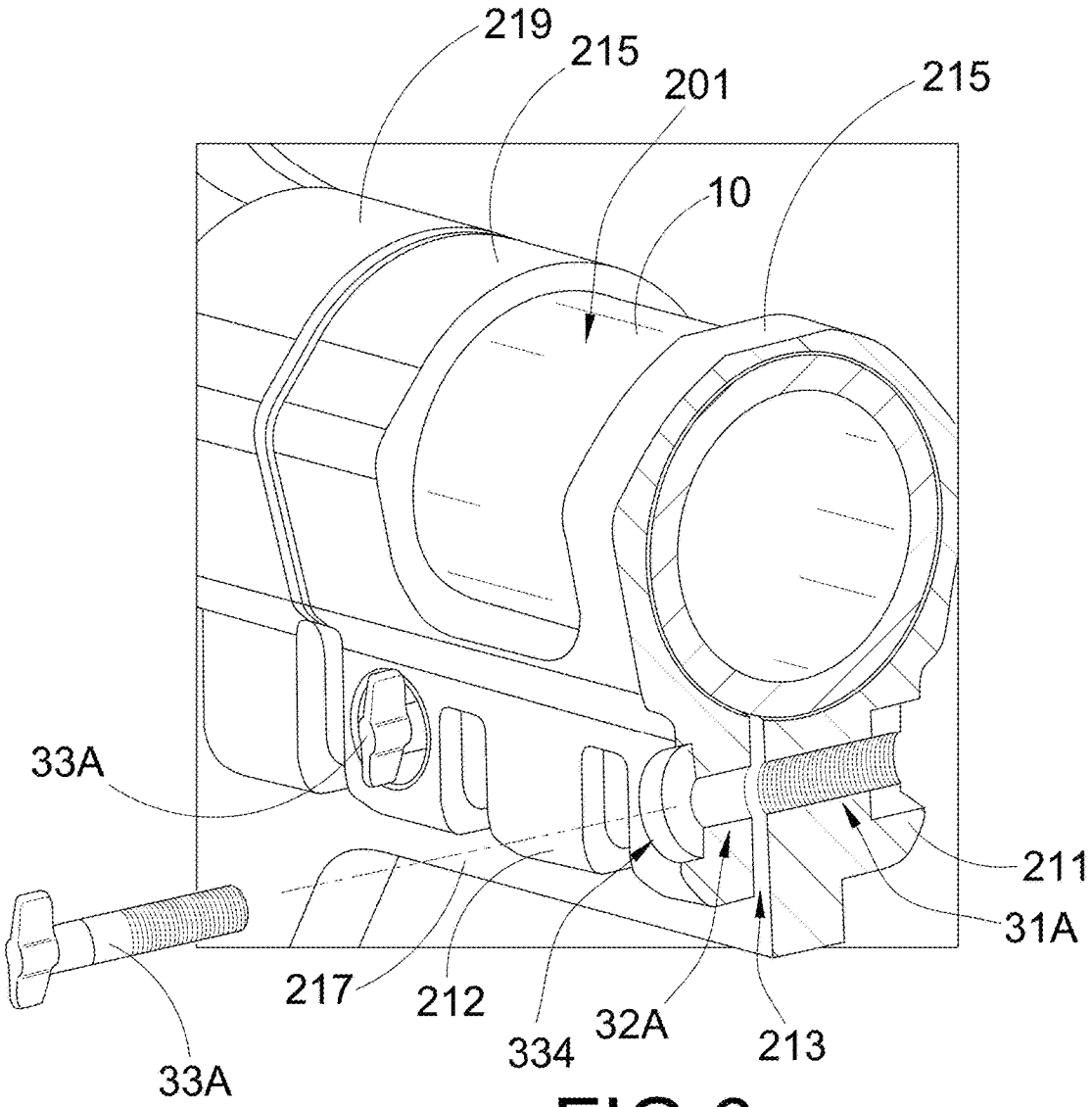
FIG. 6 illustrates an alternative mode of the locking mechanism of the universal mounting device according to the above preferred embodiment of the present invention.

FIG. 6 illustrates an alternative mode of the locking mechanism 30A which comprises at least a first locking slot 31A formed at the stationary edge 211 of the holding member 21, at least a second locking slot 32A formed at the free edge 212 of the holding member 21 to coaxially align with the first locking slot 31A, and an actuation locker 33A extended to the first locking slot 31A through the second locking slot 32A to move the free end 212 of the holding member 21 toward the stationary edge 211 thereof.

Accordingly, the actuation locker 33A comprises a locking bolt having an outer threaded portion extended from the second locking slot 32A to rotatably engage with an inner threaded portion of the first locking slot 31A. Preferably, the actuation locker 33A is a hand screw that no tool is required for driving the actuation locker 33A, such that the user is able to rotate the actuation locker 33A by hand. The differences between the locking mechanism 30 and the locking mechanism 30A are that, in FIG. 5, no inner threaded portion is formed each of the first and second locking slots 31, 32, wherein the locking bolt 331 is engaged with the locking nut 332 to selectively adjust the diameter size of the holding channel 201. In FIG. 6, the inner threaded portion is only formed at the first locking slot 31A, wherein the locking bolt of the actuation locker 33A is engaged with the first locking slot 31A without the locking nut to selectively adjust the diameter size of the holding channel 201.

Figure 7:
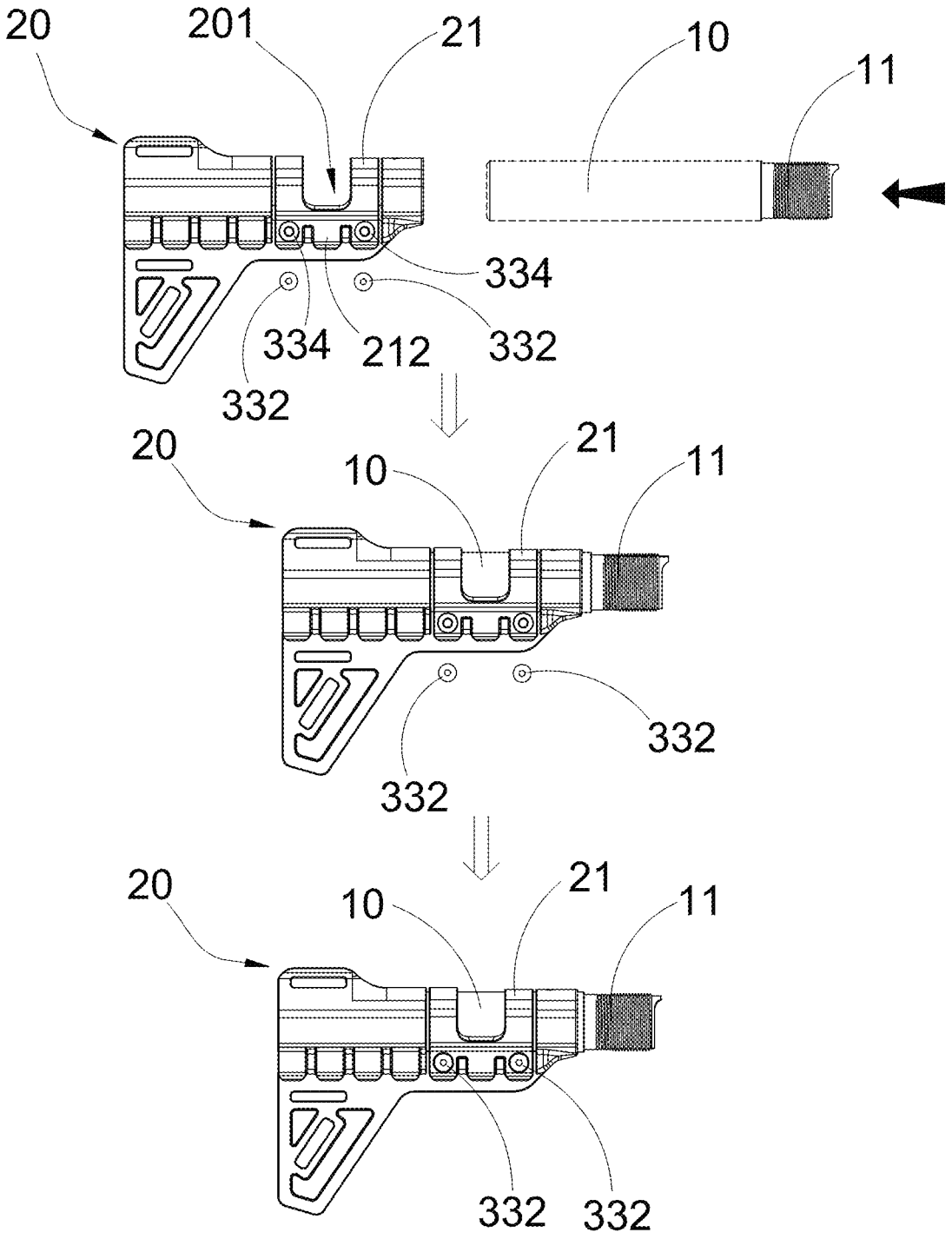
FIG. 7 illustrates a method of connecting the connecting extension with the universal mounting device according to the above preferred embodiment of the present invention.

FIG. 7 illustrates a method of mounting the universal mounting device to the pistol, comprising the following steps.

(1) Couple the front end 11 of the connecting extension 10 to a rear end of the pistol at the armrest 1 thereof.

(2) Slide the connecting extension 10 along the holding channel 201 of the buttstock body 20. In one embodiment, the connecting extension 10 is slid from the front channel 202 to the rear channel 203 through the holding channel 201.

(3) Lock up at least a portion of the connecting extension 10 at the holding channel 201 via the locking mechanism 30 by reducing the diameter size of the holding channel 201 in order to tightly press the inner wall of the holding channel 201 at the outer wall of the connecting extension 10.

It is worth mentioning that the connecting extension 10 can be coupled to the pistol after the connecting extension 10 is locked at the buttstock body 20 via the locking mechanism 30. Preferably, the connecting extension 10 is coupled to the pistol before the connecting extension 10 is locked at the buttstock body 20.

According to the step (3), in one embodiment, the locking nut 331 is placed at the stationary edge 211 of the holding member 21 and is disposed within the nut cavity 333. Then, the locking bolt 332 is extended through the first and second locking slots 31, 32 to engage with the locking nut 331 until the pressing head of the locking bolt 332 is received in the bolt cavity 334. Through the engagement between the locking nut 331 and the locking bolt 332, the adjustment clearance 213 is adjustably reduced to adjustably reduce the diameter size of the holding channel 201. Therefore, the inner wall of the holding channel 201 is tightly pressed at an outer wall of the connecting extension 10 to lock up the connecting extension 10 at the holding channel 201

Alternatively, the hand screw of the actuation locker 33A can be extended through the second locking slot 32A to rotatably engage with the first locking slot 31A to adjustably reduce the diameter size of the holding channel 201.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A universal mounting assembly for a pistol armrest, comprising:

a connecting extension, which has an elongated structure, having a front end adapted for detachably coupling to the pistol armrest; and a universal mounting device which comprises:

a buttstock body having an elongated holding channel, wherein said connecting extension is slidably coupled at said holding channel of said buttstock body at a position that said front end of said connecting extension is frontwardly extended from said buttstock body; and a locking mechanism provided at said buttstock body to selectively adjust a diameter size of said holding channel, wherein when said connecting extension is slid along said holding channel, said locking mechanism is actuated to reduce said diameter size of said holding channel to lock up at least a portion of said connecting extension at said holding channel, wherein said buttstock body comprises a tubular holding member defining said holding channel therealong and having a stationary edge integrally extended from said buttstock body and a free edge extended along said stationary edge, wherein said locking mechanism is actuated to press said free end of said holding member toward said stationary edge thereof to reduce said diameter size of said holding channel so as to lock up said connecting extension at said holding channel, wherein said locking mechanism comprises at least a first locking slot formed at said stationary edge of said holding member, at least a second locking slot formed at said free edge of said holding member to coaxially align with said first locking slot, and an actuation locker extended to said first locking slot through said second locking slot to move said free end of said holding member toward said stationary edge thereof, wherein said actuation locker comprises a locking nut positioned at said stationary edge of said holding member and a locking bolt extended from said second locking slot through said first locking slot to rotatably engage with said locking nut so as to press said free edge of said holding member to said stationary edge thereof, wherein said holding member comprises two spaced apart holding rings to define a holding window therebetween, wherein said stationary edge is integrally extended from two corresponding ends of said holding rings while said free edge is integrally extended from another two corresponding ends of said holding rings.

2. The universal mounting assembly, as recited in claim 1, wherein said buttstock body comprises a front retention member having a front channel and a rear retention member having a rear channel, wherein said holding member is supported between said front and rear retention members at a position that said holding channel is aligned between said front and rear channels, such that said connecting extension is slid along said front and rear channels and is tightly locked at said holding channel.

3. The universal mounting assembly, as recited in claim 2, wherein said buttstock body further comprises a stock base, wherein said front and rear retention members are integrally and upwardly extended from said stock base, wherein said stationary edge of said holding member is integrally and upwardly extended from said stock base between said front and rear retention members.

4. A universal mounting assembly for a pistol armrest, comprising:

a connecting extension, which has an elongated structure, having a front end adapted for detachably coupling to the pistol armrest; and a universal mounting device which comprises:

a buttstock body having an elongated holding channel, wherein said connecting extension is slidably coupled at said holding channel of said buttstock body at a position that said front end of said connecting extension is frontwardly extended from said buttstock body; and a locking mechanism provided at said buttstock body to selectively adjust a diameter size of said holding channel, wherein when said connecting extension is slid along said holding channel, said locking mechanism is actuated to reduce said diameter size of said holding channel to lock up at least a portion of said connecting extension at said holding channel, wherein said buttstock body comprises a tubular holding member defining said holding channel therealong and having a stationary edge integrally extended from said buttstock body and a free edge extended along said stationary edge, wherein said locking mechanism is actuated to press said free end of said holding member toward said stationary edge thereof to reduce said diameter size of said holding channel so as to lock up said connecting extension at said holding channel, wherein said locking mechanism comprises at least a first locking slot formed at said stationary edge of said holding member, at least a second locking slot formed at said free edge of said holding member to coaxially align with said first locking slot, and an actuation locker extended to said first locking slot through said second locking slot to move said free end of said holding member toward said stationary edge thereof, wherein said actuation locker comprises a hand screw having an outer threaded portion extended from said second locking slot to rotatably engage with an inner threaded portion of said first locking slot, wherein said holding member comprises two spaced apart holding rings to define a holding window therebetween, wherein said stationary edge is integrally extended from two corresponding ends of said holding rings while said free edge is integrally extended from another two corresponding ends of said holding rings.

5. The universal mounting assembly, as recited in claim 4, wherein said buttstock body comprises a front retention member having a front channel and a rear retention member having a rear channel, wherein said holding member is supported between said front and rear retention members at a position that said holding channel is aligned between said front and rear channels, such that said connecting extension is slid along said front and rear channels and is tightly locked at said holding channel.

6. A universal mounting assembly for a pistol armrest, comprising:

a connecting extension, which has an elongated structure, having a front end adapted for detachably coupling to the pistol armrest; and a universal mounting device which comprises:

a buttstock body having an elongated holding channel, wherein said connecting extension is slidably coupled at said holding channel of said buttstock body at a position that said front end of said connecting extension is frontwardly extended from said buttstock body; and a locking mechanism provided at said buttstock body to selectively adjust a diameter size of said holding channel, wherein when said connecting extension is slid along said holding channel, said locking mechanism is actuated to reduce said diameter size of said holding channel to lock up at least a portion of said connecting extension at said holding channel, wherein said buttstock body comprises a tubular holding member defining said holding channel therealong and having a stationary edge integrally extended from said buttstock body and a free edge extended along said stationary edge, wherein said locking mechanism is actuated to press said free end of said holding member toward said stationary edge thereof to reduce said diameter size of said holding channel so as to lock up said connecting extension at said holding channel, wherein said buttstock body comprises a front retention member having a front channel and a rear retention member having a rear channel, wherein said holding member is supported between said front and rear retention members at a position that said holding channel is aligned between said front and rear channels, such that said connecting extension is slid along said front and rear channels and is tightly locked at said holding channel.

7. The universal mounting assembly, as recited in claim 6, wherein said buttstock body further comprises a stock base, wherein said front and rear retention members are integrally and upwardly extended from said stock base, wherein said stationary edge of said holding member is integrally and upwardly extended from said stock base between said front and rear retention members.

8. The universal mounting assembly, as recited in claim 5, wherein said buttstock body further comprises a stock base, wherein said front and rear retention members are integrally and upwardly extended from said stock base, wherein said stationary edge of said holding member is integrally and upwardly extended from said stock base between said front and rear retention members.

* * * * *